United States Patent [19]

Lin

[11] Patent Number: 4,839,784

[45] Date of Patent: Jun. 13, 1989

[54] CANDLE-LIKE LIGHTING DEVICE

[75] Inventor: Ling-Yung Lin, Taipei, Taiwan

[73] Assignee: New Fei Lien Enterprise Co., Ltd., Taipei, Taiwan

[21] Appl. No.: 157,234

[22] Filed: Feb. 18, 1988

[51] Int. Cl.[4] ..... F21V 35/00

[52] U.S. Cl. ..... 362/393; 362/157; 362/161; 362/190; 362/397; 362/427; 362/810

[58] Field of Search ..... 362/157, 161, 190, 191, 362/397, 427, 393, 430, 810, 392

[56] References Cited

U.S. PATENT DOCUMENTS

| | | | |
|---|---|---|---|
| 1,094,409 | 4/1914 | Green et al. | 362/397 X |
| 1,276,467 | 8/1918 | Widstrand | 362/397 X |
| 1,597,609 | 8/1926 | Mabon | 362/190 |
| 1,915,125 | 6/1933 | Floraday | 362/191 |

*Primary Examiner*—Stephen F. Husar
*Assistant Examiner*—Sue Hagarman
*Attorney, Agent, or Firm*—Browdy and Neimark

[57] ABSTRACT

The present disclosure is concerned with an electrically powered candle-like lighting device having a candle body with a bulb disposed at the top thereof, which is mounted on a candle holder pivotably adjusted in a plane within 180 degrees, and the candle holder is further secured to a candle base provided with a sucker received at the concaved bottom thereof in such a manner that the base can be spinned freely with respect to the fixed sucker, thereby the whole light assembly can be fixed on any surface, horizontal, vertical or inclined with the candle body adjustably posed within a half-sphere range.

1 Claim, 3 Drawing Sheets

CANDLE-LIKE LIGHTING DEVICE

BACKGROUND OF THE INVENTION

1. Field of the Invention

The present invention relates to an improved electrically powered candle-like lighting device having a candle body with a bulb disposed at the top thereof, which is mounted on a candle holder and pivotably adjusted in a plane within a range of 180 degrees, and the candle holder is further mounted on a candle base with a suction cup received at the concaved bottom thereof, and the candle base is engaged with said suction cup in such a manner that the candle base can be freely spun in a clockwise direction or vice versa in 360 degrees, thus the candle body can, as a result be posed in any position within a half-sphere range after the candle base is removably fixed on any plane horizontal, vertical, or inclined,by means of the sucker.

2. The Prior Art

Candle-like lighting devices have been popularly employed in common families, churches or the like as decoration objects in special occasions such as Christmas, Thanksgiving Day or the like. Most of the prior arts are fixed in an invariable manner only on a horizontal plane such as a table or the like. Furthermore, to prevent the prior arts from easily being toppled, the cnadle base must be heavy enough, thus resulting in a relative high cost of delivery and waste of material in production.

SUMMARY OF THE INVENTION

To eliminate the above cited shortcomings, the present inventor has come up with an improved electrically powered candle-like lighting device to faciliate the mounting and adjustment thereof.

Therefore, the primary object of the present invention is to provide an improved electrically powered candlelike lighting device having a candle body with a bulb disposed at the top thereof, which is able to be adjusted within a half-sphere range, i.e., the candle body being pivoted in a plane within a range of 180 degrees with the candle base, on which said candle holder is mounted, being freely rotated in 360 degrees clockwise or counterclockwise with respect to a sucker disposed at the bottom of said base for effecting ready attachment of the present lighting device on any horizontal, vertical or inclined plane having a smooth surface.

Another object of the present invention is to provide an improved electrically powered candle-like lighting device having a candle body mounted on a candle holder which is in turn pivotably fixed on a candle base with a suction cup disposed at the concave bottom thereof so to prevent the lighting device form being easily toppled by accident and to facilitate the same to stick to any smooth surface.

BRIEF DECRIPTION OF THE DRAWINGS

The features, operation mode and structure of the present lighting device are better illustrated by way of the following detailed description of the present invention in company with a number of drawings, in which.

DETAILED DESCRIPTION OF THE PREFERRED EMBODIMENT

Figure 1:
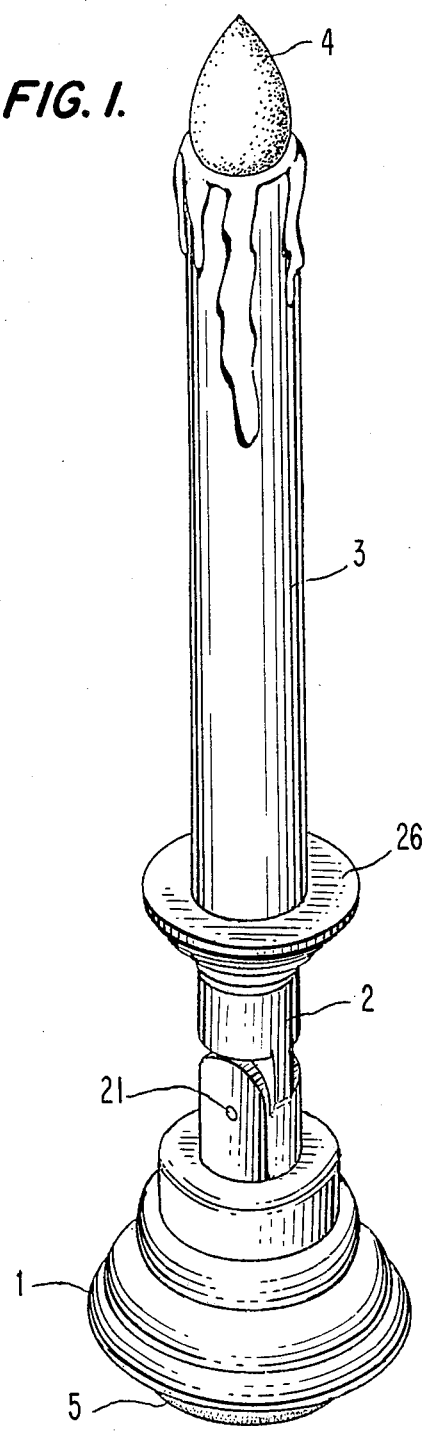
FIG. 1 is a perspective view of the present invention.

Refer first to FIG. 1, the present invention comprises a base 1 having a candle holder 2 disposed thereon. A pin 21 is used to pivotally couple said candle holder 2 to said candle base 1 which is formed in a step-like manner with each circular layer having reducing diameter from bottom to top superimposedly disposed. At the concaved bottom of said base 1 sucker or suction cup 5 is disposed for removably fixing the same to any smooth surface, vertical, horizontal or inclined. A candle body 3 with a bulb 4 disposed at the top thereof.

Figure 3:
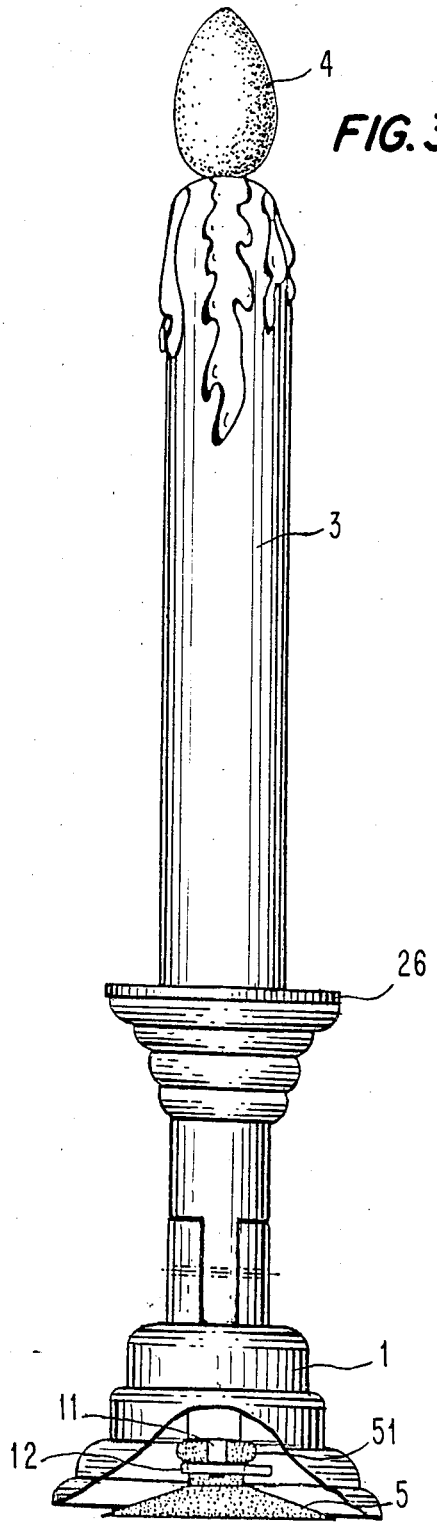
FIG. 3 is a side view of the present invention with a partially removed bottom section, exposing the sucker disposed at the bottom of the candle base.
Figure 2A:
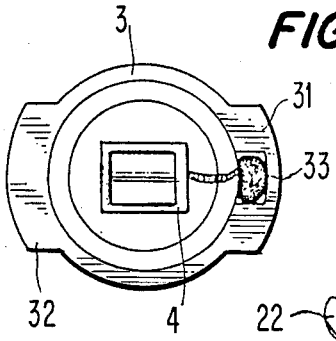
FIG. 2A is a bottom view showing the inner wiring of the candle body.
Figure 2:
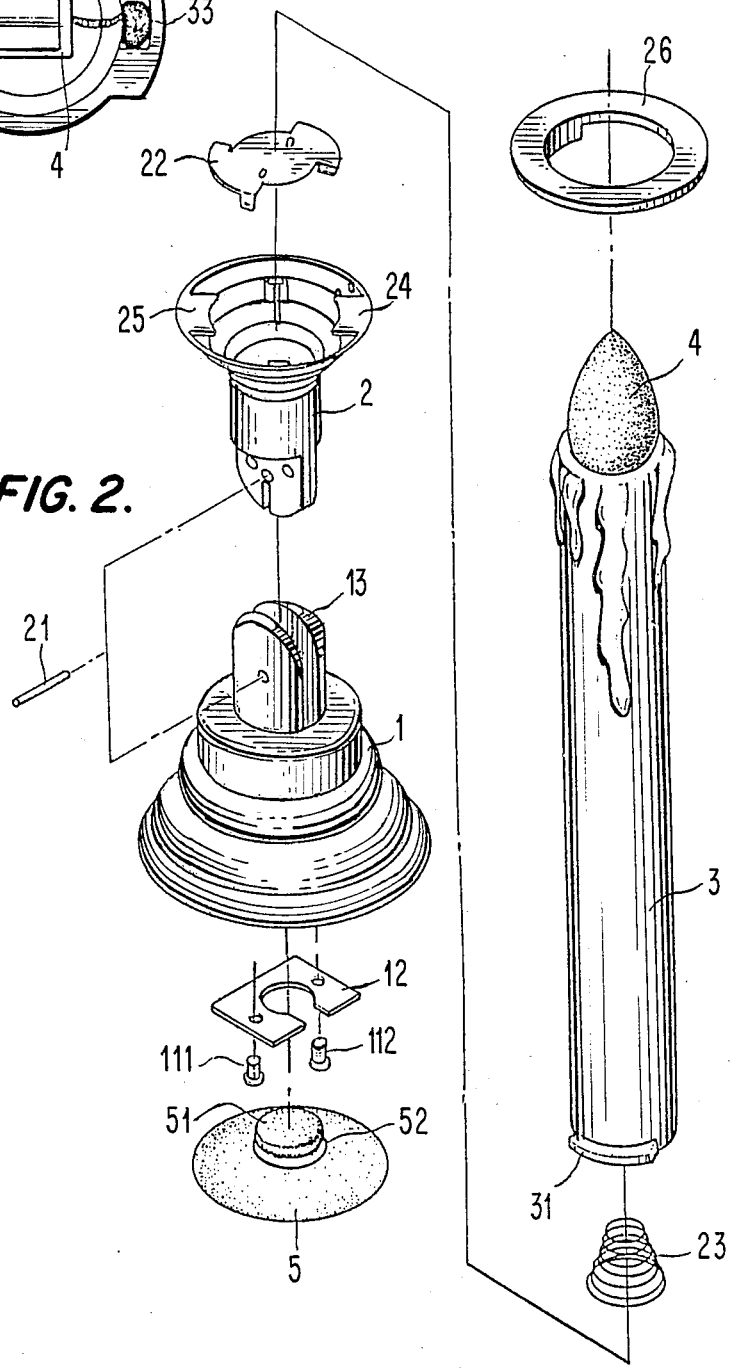
FIG. 2 is a perspective view showing the exploded components of the present invention.
Figure 4:
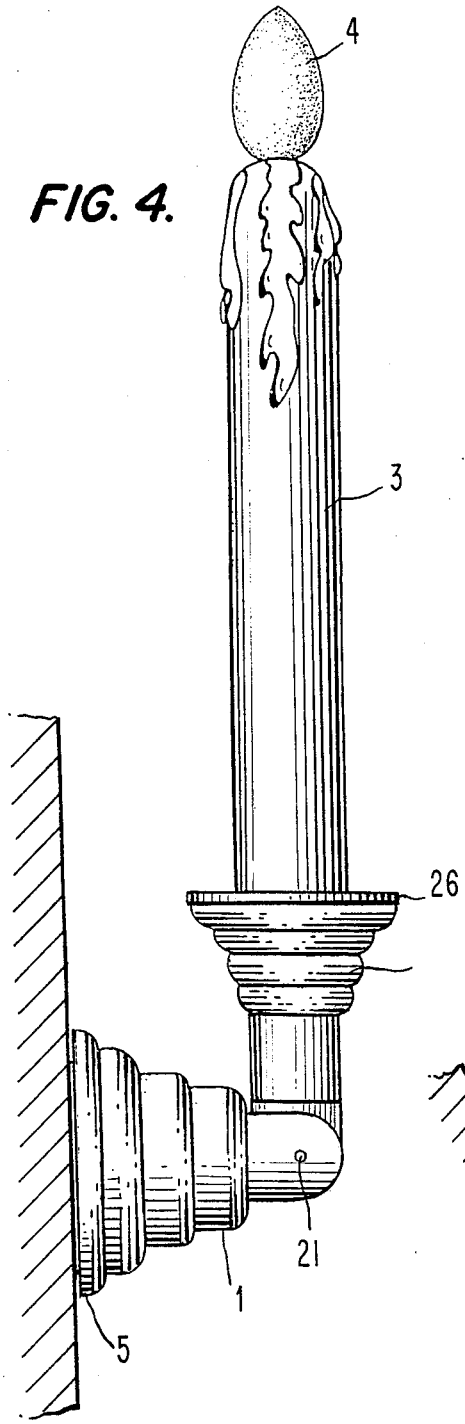
FIG. 4 is a diagram showing one way of arranging the present invention.
Figure 5:
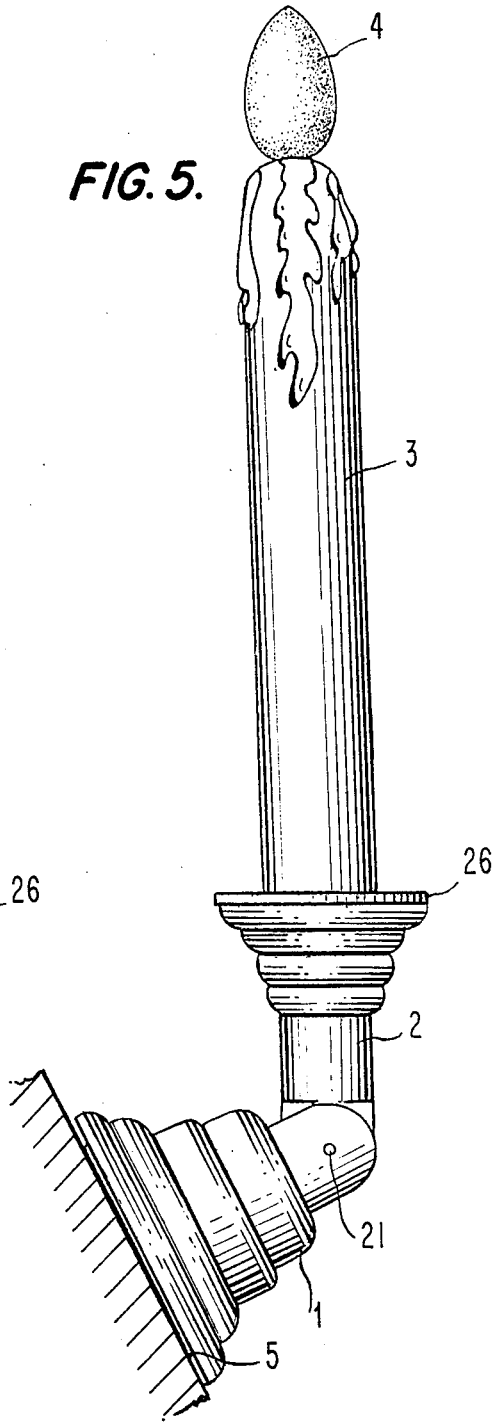
FIG. 5 is a diagram showing another way of arranging the present invention.

As shownin FIG. 2 and FIG. 3, the concaved bottom of said candle base 1 is provided with a pair of downward protruding rods 11 each having a threaded hole for receiving a pair of screws 111, 112, and a piece of rectangular iron plate 12 having a cut disposed on one side thereof. A circular opening is located at the center of said plate 12, in communication with said cut. A pair of symmetric holes are also disposed on opposing sides of the circular opening so that the iron plate 12 can be screwed to the projecting rods 11.

Said suction cup 5 has a circular projection 51 disposed on the top thereof which is guided through said cut and located and held in said opening of said iron plate 12 so to effect the fixing of the same. To make the candle base readily rotatably movable with respect to the suction cup 5, a metal ring 52 is disposed around the neck portion defined between the suction cup 5 and said circular projection 51. A pair of lugs 13 are disposed on the top of said candle base 1 with a space defined therebetween. Correspondingly, a joining extension is disposed at the bottom of said candle holder 2 and is fitted into the space between said lugs 13, and a pin 21 is used to pivotably join the candle holder 2 and said candle base 1 together so that the present invention can be adjustably fixed at any position in a plane within a range of 180 degrees with the candle base 1 freely rotatable, clockwise or counterclockwise, with respect to said fixed suction cup 5, thus permitting the candle body 3 to be adjusted within a half-sphere range.

The top of said candle holder 2 is provided with a flared cup portion having on its periphery a pair of opposite wing portions 24, 25. A metal plate 22 with a coil spring 23 disposed thereon is received in the cup portion. A pair of flanges 31, 32 disposed at the bottom wall of said candle body are able to be in locking engagement with said wing portions 24, 25. A ring element 26 is disposed at the bottom of said candle body 3 with a bulb 4 placed at the topmost end of said candle body 3. A conducting wire is fixed in the interior of said candle body 3 and connected to the flange 31 by a conducting point 33 with a number of batteries disposed therein. In assembly, the flange 31 is able to be in selective contact with said metal plate 22 by rotating the candle body 3 for creating a conducting circuit or vice versa, i.e. to turn on or off the present candle-like lighting device.

What is claimed is:

1. A candle-like lighting means comprising:

a candle base defined in a step like form having superimposedly disposed circular layers with reducing diameter from bottom to top with a pair of lugs disposed at a top of the base, and a space being defined between said lugs;

a candle holder having a flared cup portion at the top thereof and a downward joining extension disposed in between said lugs in assembly for effecting the pivotal coupling of the same to said candle base by a pin;

a metal plate received in the flared cup portion;

a spring disposed on top of said metal plate;

an elongate hollow candle body having a flange portion disposed on the bottom wall thereof, with batteries received therein, said flange portion being adapted to selectively contact said metal plate to turn the lighting means on or off;

a suction means removably disposed at the bottom of said candle base and having a circular projection on the top thereof with a metal ring disposed around a neck portion which connects the circular projection and the suction means;

a bulb disposed at the topmost end of said candle body;

a rectangular iron plate having a central circular opening, and a cut disposed on one side thereof which is in communication with said central opening, and a pair of symmetric screw holes being disposed on said iron plate, and circular projection of said suction means engaging with said iron plate for attaching said suction means to said iron plate;

a ring element being disposed on top of said flared cup portion at the bottom of said candle body; and a pair of projecting rods disposed at a concave bottom portion of said candle base and each having a screw hole for securing said rectangular iron plate to the projecting rods by means of a pair of screws for mounting of said suction means.

* * * * *